United States Patent [19]

Kosuda et al.

[11] 4,200,074

[45] Apr. 29, 1980

[54] FUEL INJECTION SYSTEM FOR AN INTERNAL COMBUSTION ENGINE

[75] Inventors: Tooru Kosuda, Okazaki; Michihiro Ohashi, Handa; Hiromi Katou, Nishio, all of Japan

[73] Assignee: Nippon Soken, Inc., Nishio, Japan

[21] Appl. No.: 907,620

[22] Filed: May 19, 1978

[30] Foreign Application Priority Data

May 23, 1977 [JP] Japan ..... 52/60313

[51] Int. Cl.[2] ..... F02M 41/04

[52] U.S. Cl. ..... 123/139 BG; 123/139 BC; 123/139 AW; 261/50 A

[58] Field of Search ..... 123/139 AW, 139 BD, 123/139 BC, 139 BG, 140 MP, 119 R; 261/50 A

[56] References Cited

U.S. PATENT DOCUMENTS

| | | | |
|---|---|---|---|
| 1,951,340 | 3/1934 | Bohuslav | 123/139 BD |
| 2,455,571 | 12/1948 | Edwards | 123/139 BD |
| 2,582,535 | 1/1952 | Drouot | 123/139 BD |
| 2,839,999 | 6/1958 | Shallenberg | 123/139 BC |
| 2,955,583 | 10/1960 | Dahl et al. | 123/139 AW |
| 4,040,405 | 8/1977 | Tanaka et al. | 123/139 BG |

FOREIGN PATENT DOCUMENTS

| | | | |
|---|---|---|---|
| 1139068 | 11/1958 | France | 123/139 BD |
| 912725 | 12/1962 | United Kingdom | 123/139 BD |

*Primary Examiner*—Charles J. Myhre
*Assistant Examiner*—P. S. Lall
*Attorney, Agent, or Firm*—Cushman, Darby & Cushman

[57] ABSTRACT

A fuel injection system for an internal combustion engine has an air sensor for metering the intake air flow into the engine and a fuel metering and distributing device hydraulically coupled together. The device includes a plunger rotated by the engine to distribute fuel to respective fuel injectors and axially moved in response to variation in the intake air flow rate to meter the fuel. The axial displacement of the plunger is determined by two opposing hydraulic pressures acting on the opposite ends of the plunger, one of which is varied in accordance with the engine intake air flow rate as detected by the air sensor while the other hydraulic pressure is changed in accordance with the axial displacement of the plunger. Since no mechanical linkage is required between the air sensor and the fuel metering and distributing device, the system can easily be installed in a limited space and, in addition, assure an improvement in the accuracy of the fuel control.

4 Claims, 9 Drawing Figures

FUEL INJECTION SYSTEM FOR AN INTERNAL COMBUSTION ENGINE

BACKGROUND OF THE INVENTION

1. Field of the Invention

The present invention relates to a system for injecting a fuel into internal combustion engine and, more particularly, to a fuel injection system for an internal combustion engine adapted to control the rate of the fuel injection in linear relation with the varying flow rate of intake air induced into the engine.

Description of the Prior Art

A fuel injection system of the kind specified is disclosed, for example, in U.S. Pat. No. 3,996,910 and, therefore, has been publicly known. This known fuel injection system includes an air metering plate disposed in the intake duct of an engine and adapted to be angularly displaced in response to the change of intake air flow rate. The angular displacement of the air metering plate is mechanically transmitted through a link mechanism to a plunger so as to axially displace the latter thereby to effect a distribution and metering of the fuel.

This known fuel injection system, however, has a drawback that the size of the whole system is large due to the fact that an intake air sensor having the air metering plate and a fuel controlling mechanism for performing the distribution and metering of the fuel are assembled together into a unitary structure. Thus, the known fuel injection system inconveniently occupies an impractically large space in an engine compartment of an automobile.

The known fuel injection system, moreover, requires a highly complicated link mechanism for obtaining a linear relation between the angular displacement of the air metering plate and the axial reciprocative movement of the plunger. In addition, the desired linear relation can hardly be obtained, evey by such a complicated link mechanism, because of the mechanical play involved in the latter.

As a measure for overcoming above-stated problems, an improved fuel injection system has been disclosed in U.S. patent application Ser. No. 693,951 of the same assignee (Nippon Soken, Inc.) as that of the present application, now issued as U.S. Pat. No. 4,040,405.

In this improved fuel injection system, the angular displacement of an air metering plate caused by a change of the intake air flow rate is converted into a hydraulic pressure signal. A control shaft adapted to determine the fuel injection rate is axially moved in accordance with the hydraulic pressure signal to control the rate of the fuel injection.

This newly proposed system overcomes the above stated problems to a certain extent. However, this fuel injection system has another disadvantage. More specifically, the hydraulic pressure signal according to the metered intake air flow rate is applied to one axial end of the control shaft, while the other end of the shaft is subjected to a return spring force which acts in the counter direction to the hydraulic pressure signal, so that the control shaft may be axially moved to a position where the axial forces caused by the hydraulic pressure signal and the spring force balance. The use of the spring for determining the axial position of the control shaft is apt to incur a deterioration of the accuracy or precision of the fuel control because there may be a fluctuation of spring constant of the springs and because the spring constant of a spring is varied due to the secular variation. Further, from a practical point of view, it is extremely difficult to obtain a hydraulic pressure signal which acts on one axial end of the control shaft substantially in proportion to the intake air flow rate. Thus, it is materially impossible to obtain the axial displacement of the control shaft in exact proportion to the intake air flow rate because the spring return force is in correct proportion to the axial displacement of the control shaft, while the counter hydraulic pressure signal, as stated above, cannot correctly be proportional to the intake air flow rate.

SUMMARY OF THE INVENTION

It is an object of the present invention to overcome the above-discussed problems of the prior art by providing an improved fuel injection system which can easily be installed within a limited space and which can perform a highly precise fuel metering and distributing operation.

According to the present invention, there is provided a fuel injection system for an internal combustion engine, comprising a housing having a fuel inlet port and fuel outlet ports formed therein, a plunger mounted in said housing rotatably and axially movably to meter the fuel from said fuel inlet port and distribute the metered fuel to said fuel outlet ports, two hydraulic pressure chambers disposed at respective axial ends of said plunger, the hydraulic pressures in said hydraulic pressure chambers determining the axial displacement of said plunger, an intake air flow-hydraulic servo mechanism having a first variable orifice operative in response to a change of the intake air flow rate to vary the hydraulic pressure in one of said pressure chambers, and a second variable orifice for controlling the hydraulic pressure in the other pressure chamber in accordance with the axial displacement of said plunger, whereby said plunger is axially moved to a position where the hydraulic pressures in said pressure chambers are balanced.

The above and other objects, features and advantages of the invention will become more clear from the following description of the preferred embodiments with reference to the accompanying drawings.

DESCRIPTION OF PREFERRED EMBODIMENTS

Figure 1:
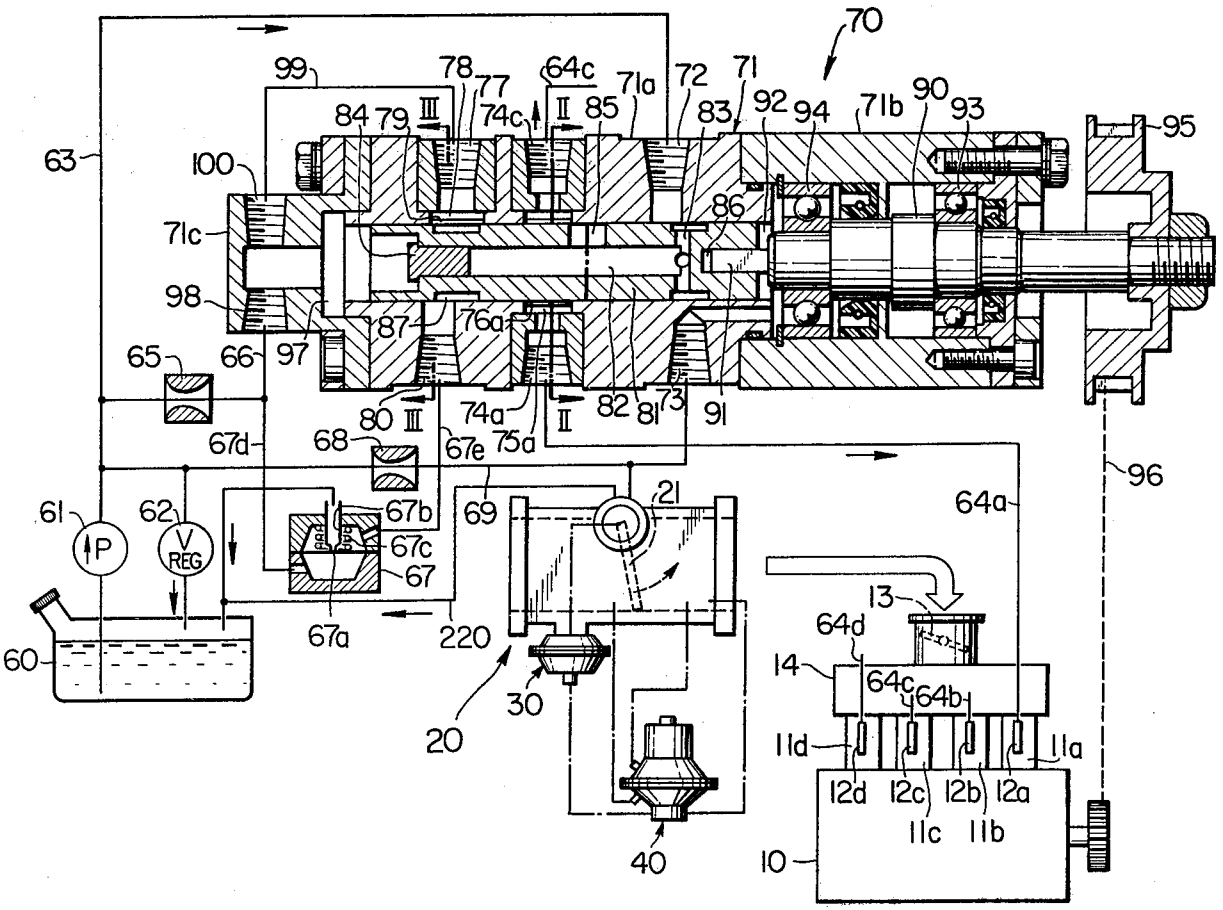
FIG. 1 is a partly diagrammatic and partly sectional illustration of a fuel injection system embodying the present invention with the section taken on line I—I in FIG. 2.

Referring to FIGS. 1 to 7, an internal combustion engine 10, which is an ordinary 4-stroke, reciprocal piston, spark ignition engine, has intake manifold branches 11*a*, 11*b*, 11*c* and 11*d* through which air is induced into the engine 10. A liquid fuel is injected into the intake manifold branches through fuel injectors 12*a*, 12*b*, 12*c* and 12*d*. These fuel injectors are of a type that automatically injects the fuel when the fuel pressure exceeds a predetermined pressure.

The air supply to the intake manifold branches is made through an air cleaner (not shown), an intake air flow-hydraulic servo mechanism 20, a throttle valve 13 and a surge tank 14. The intake air flow rate, which can optionally be changed by a throttle valve 13, is metered and converted into a hydraulic pressure signal by the intake air flow-hydraulic servo mechanism 20.

The intake air flow-hydraulic servo mechanism 20 includes a metering plate 21 adapted to detect or sense the intake air flow rate, and a fuel metering means adapted to cooperate with the metering plate 21 to produce a hydraulic signal which is in linear relation with the intake air flow rate. The opening degree of the metering plate 21 is controlled by a pressure responsive means 30 and a constant differential pressure valve 40 such that a constant pressure differential across the metering plate 21 is obtained.

Turning now to the fuel circuit, the fuel is pumped up from a fuel tank 60 by means of an electrically driven fuel pump 61. A fuel pressure regulator 62 is adapted to release excessive fuel back to the fuel tank 60 by comparing the fuel pressure with a reference pressure. In the illustrated embodiment, the intake vacuum in the surge tank 14 is used as the reference pressure. Thus, the pressure regulator regulates the pressure of the fuel such that the fuel pressure is kept constant (e.g. 2 to 10 atm) with respect to the reference pressure. The fuel of the regulated pressure is then supplied to a fuel controlling mechanism or a fuel metering and distributing device 70 through respective fuel pipes. More specifically, the fuel is supplied through a fuel pipe 63 to the fuel controlling mechanism 70 which in turn delivers the fuel to the respective fuel injectors 12*a*–12*d* through respective fuel pipes 64*a*–64*d*.

A fuel pressure, which is regulated by a constant differential pressure valve 67, is introduced into the fuel controlling mechanism 70 through a fixed orifice 65 and a conduit 66. This constant differential pressure valve 67 has a metallic diaphragm 67*a* and a tube 67*b* which cooperate together to form a variable restriction. Thus, this valve 67 is of a known type which functions to maintain a constant pressure differential between two chambers separated from each other by the diaphgram 67*a*. The constant pressure differential is determined by the force of a spring 67*c*. The lower chamber is connected to the fixed orifice 65 through a conduit 67*d*, while the upper chamber communicates with the fuel controlling mechanism 70 through a conduit 67*e*.

The fuel controlling mechanism 70 is adapted to meter the fuel in accordance with the hydraulic pressure signal and to distribute the metered fuel to respective fuel injectors 12*a*–12*d*. This mechanism 70 is constructed separately from the intake air flow-hydraulic servo mechanism 20 and is mounted in the vicinity of a drive shaft of the internal combustion engine 10.

The fuel controlling mechanism 70 has a generally cylindrical housing 71 consisting of a plunger-supporting section 71*a*, a shaft-supporting section 71*b* and a cover section 71*c* which are connected together. A fuel inlet port 72 for the fuel to be injected is formed in the plunger-supporting section 71*a* and extends in radial direction of the latter. A pressure inlet port 73 for receiving a hydraulic pressure as controlled by the servo mechanism 20 and for controlling a plunger is formed in the plunger-supporting section 71*a* and extends in radial direction of the latter.

Figure 2:
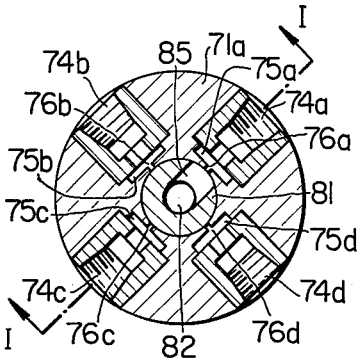
FIG. 2 is a sectional view taken along line II—II in FIG. 1.
Figure 3:
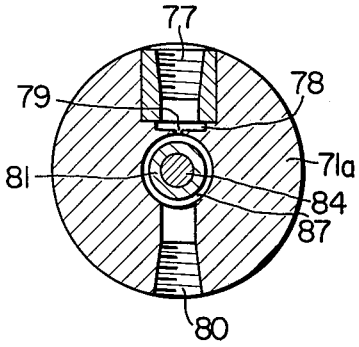
FIG. 3 is a sectional view taken along line III—III in FIG. 1.

Further, as most clearly shown in FIG. 2, the plunger-supporting section 71*a* has four radial bores which are circumferentially spaced at intervals of 90°. These radial bores are fitted with cylindrical members defining fuel outlet ports 74*a*–74*d*, respectively. Grooves 75*a*–75*d* are formed in the housing section 71*a* in communication with the fuel outlet ports 74*a*–74*d*, respectively, and are also in communication with respective elongated fuel metering slits 76*a*–76*d* also formed in the housing section 71*a*. Further, a cylindrical member defining a hydraulic pressure inlet 77 is fixedly received in a radial bore in the plunger supporting section 71*a*. A groove 78 formed in communication with the hydraulic pressure inlet 77 is in communication with a slit 79 also formed in the housing section 71*a*. A fuel return port 80 is formed radially through the wall of the plunger-supporting section 71*a* in diametrically opposed relationship to the hydraulic pressure inlet 77.

An axial cylindrical bore is formed in the plunger-supporting section 71*a* and snugly and sealingly receives a plunger 81 for controlling the fuel supply so that the plunger is rotatable and axially movable relative to the section 71*a*. The plunger 81 has an internal fuel passage 82 adapted to receive the fuel through a fuel receiving port 83 which is formed in the wall of the plunger 81 at a portion of the latter substantially corresponding to the position of the fuel inlet port 72 of the plunger supporting section 71*a*.

The fuel passage 82 formed axially through the plunger 81 is closed at its one end by a plug 84. A substantially sector orifice 85 is formed in the wall of the plunger 81 so as to distribute the fuel to respective fuel outlet ports 74*a*–74*d*.

A projection 91 of a drive shaft 90 is splined to a groove 86 which is formed in the right-hand axial end of the plunger 81 so that the plunger 81 may be rotatably driven by the drive shaft 90 and is axially movable, independently of the drive shaft 90, in accordance with the hydraulic pressure transmitted to a working chamber 92 through the port 73.

The plunger 81 further has a groove 87 formed in the outer peripheral surface thereof. The groove 87 communicates with the aforementioned slit 79 of the plunger-supporting section 71*a* and cooperates with the slit 79 to form a variable orifice. The area of mutual communication of the slit 79 and the groove 87 is varied in accordance with the axial position of the plunger 81 relative to the housing section 71*a*.

The shaft-supporting section 71*b* rotatably supports the drive shaft 90 through a pair of ball bearings 93 and 94 disposed on the inner peripheral surface thereof. The drive shaft 90 is operatively connected to the drive shaft of the engine 10 through a gear 95 screwed to the right-hand end of the drive shaft and then through a cogged belt 96 so that the shaft 90 is driven by the engine 10 in timed relationship to the engine operation. The ratio of rotational speed of the engine shaft to that of the drive shaft 90 is selected to be 2:1, since the illustrated engine 10 is a 4-stroke engine which performs one cycle of operation in two full revolutions of the engine shaft. Thus, in case of a 2-stroke engine which completes one cycle of operation at each revolution of the engine shaft, the aforementioned ratio should be 1:1.

Figure 4:
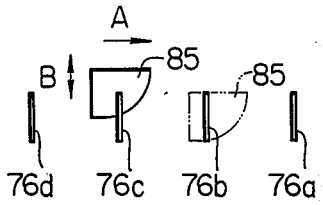
FIGS. 4 and 5 are enlarged developed views of orifices of a fuel controlling mechanism.

The distribution and metering of the fuel are effected by the mutual communication of the orifice 85 in the plunger 81 and the respective slits 76*a*–76*d* formed in the plunger-supporting section 71*a*. More specifically, the distribution of the fuel is caused by the rotation of the plunger 81, while the metering of the fuel is performed by the chanbge of angle of rotation of the plunger 81 over which each of the slits 76*a*–76*d* is communicated with the orifice 85 during one rotation of the plunger 81 and also by the variation in the area of overlap and communication between the orifice and the slits, as shown in FIG. 4.

The cover section 71*c* is adapted to cooperate with the left-hand end of the plunger supporting section 71*a* to define a working chamber 97 and has a hydraulic pressure introducing port 98 connected with the conduit 66 and a hydraulic pressure connection port 100 connected through a conduit 99 with the hydraulic pressure inlet 77. These hydraulic pressure introducing port 98 and hydraulic pressure connection port 100 are in communication with the working chamber 97.

The parts constituting the control mechanism 70 are made of quenched steel or the like material. At the same time, "O" rings or the like sealing members are used for sealing between respective machine parts.

Figure 6:
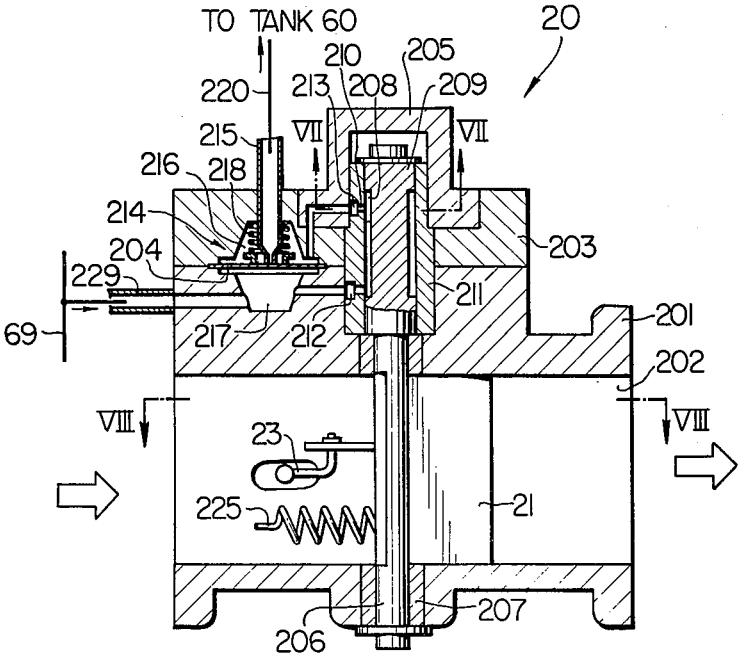
FIG. 6 is an enlarged longitudinal sectional view of an intake air flow-hydraulic servo mechanism incorporated in the system shown in FIG. 1.
Figure 7:
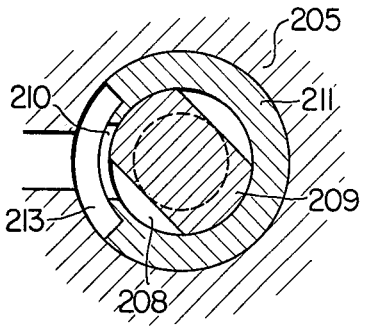
FIG. 7 is an enlarged sectional view taken along line VII—VII in FIG. 6.
Figure 8:
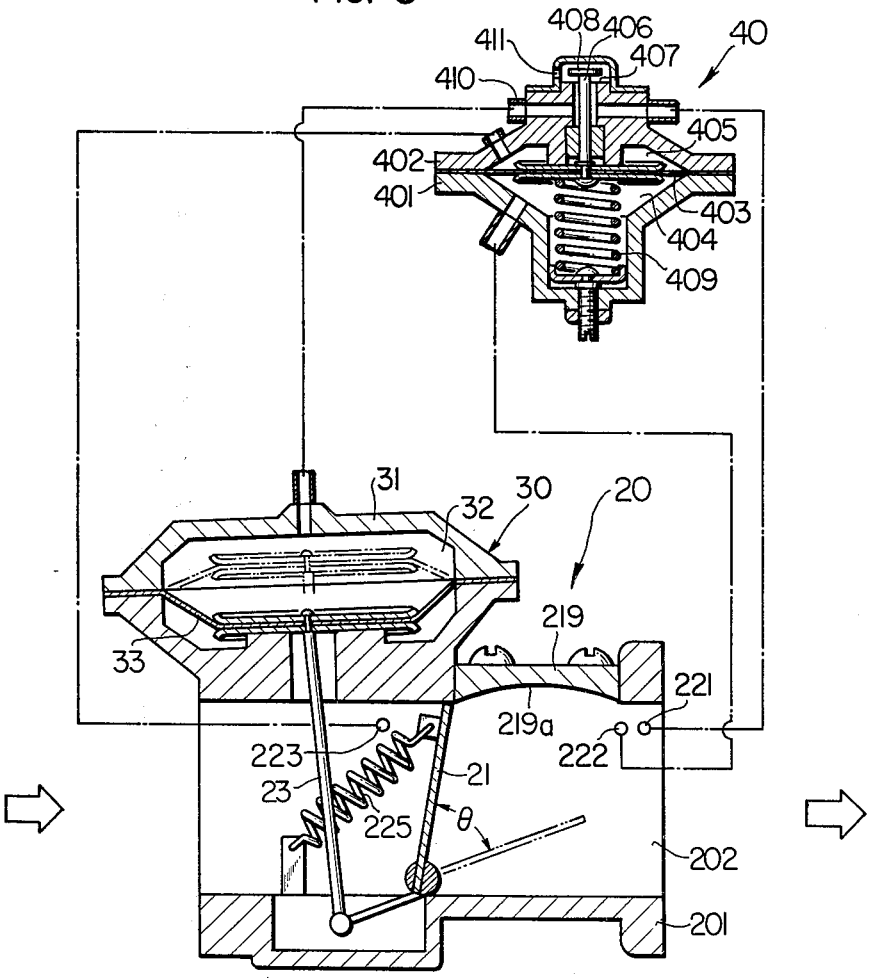
FIG. 8 is an enlarged sectional view taken along line VIII—VIII in FIG. 6 and showing in section a constant pressure-differential valve.

The construction of the intake air flow-hydraulic servo mechanism 20 will be described hereinafter with specific reference to FIGS. 6 to 8. An intake passage 202 having a substantially square cross-section is formed in a housing 201 in which the air metering plate 21 is disposed. A metallic diaphragm 204 is clamped between the housing 201 and a casing 203. A cover 205 is attached to the casing 203.

A shaft 206 secured to the metering plate 21 is rotatably supported by a bearing 207 mounted on the housing 201. A fuel metering shaft 209 having a fuel metering notch 208 formed therein is integrally connected to one end of the shaft 206 and is received by a bore of a sleeve 211 for smooth rotation therein. The sleeve 211 has an elongated slit 210 which cooperates with the notch 208 to form a variable orifice. The sleeve 211 has a fuel supply port 212 for supplying the variable orifice with the fuel and a fuel delivery port 213 through which the fuel is discharged from the variable orifice.

A constant pressure differential valve 214, which has a construction substantially similar to that of the aforementioned constant differential pressure valve 67, is adapted to maintain constant the fuel pressure differential across the variable orifice. Namely, the constant differential pressure valve 214 has a variable restriction constituted by a diaphragm 204 and the opening of a pipe 215. An upper chamber 216 and a lower chamber 217 are separated from each other by the diaphragm 204. The fuel pressures at the upstream side and downstream side of the variable orifice are introduced into the upper and the lower chambers 216 and 217, respectively. The constant differential pressure valve 214 functions to keep the fuel pressure differential between the upper and the lower chambers 216 and 217 at a constant value which is determined by a compression spring 218. Consequently, a constant pressure differential is maintained across the variable orifice.

The metering plate 21 is operatively connected to the pressure responsive means 30 through a link mechanism 23. The pressure responsive means 30 is of a type in which a diaphragm 33 is deformed by a vacuum introduced into a vacuum chamber 32 formed in a casing 31. The link mechanism 23 is directly connected to the diaphragm 33.

An intake air flow rate correcting plate 219 is disposed in the intake passage 202 in the housing 201. The correcting plate 219 has a recess 219*a* which is shaped such that the sectional area of the intake air passage is in proportion to the degree of opening $\theta$ of the air metering plate 21. The metering plate 21 is normally biased in the closing direction by means of a return spring 225.

Vacuum ports 221 and 222 and an atmospheric pressure port 223 are formed in the wall of the intake passage 202.

The aforementioned constant differential pressure valve 40 is adapted to control the vacuum to the pressure responsive means 30 so as to change the opening degree of the metering plate 21 thereby to keep constant the pressure differential across the metering plate 21 and is constituted by a diaphragm type valve of known type. More specifically, the constant differential pressure valve 40 has upper and lower housing parts 401 and 402 and a diaphragm 403 which cooperates with the housing parts to define pressure chambers 404 and 405. The pressure chamber 404 is communicated with the port 222 through a conduit, while the pressure chamber 405 is in communication with the port 223 through another conduit. A shaft 406 is connected at its one end to the diaphragm 403 and carries at its other end a valve member 408 adapted to open and close a valve seat 407. A spring 409 adapted to bias the diaphragm 403 for bringing the valve member 408 into a valve-open position is disposed in the pressure chamber 404. The arrangement is such that the vacuum from the port 221 to a vacuum passage 410 is adjusted or modulated by atmospheric pressure introduced through an atmospheric port 411, as the valve member 408 engages with and disengages from the valve seat 407, and the adjusted vacuum is introduced into the pressure responsive means 30.

In operation, the intake air is introduced into the internal combustion engine 10, via the air cleaner (not shown), intake air flow-hydraulic servo mechanism 20, throttle valve 13, surge tank 14 and respective intake manifold branches 11*a*–11*d*.

When the intake air passes through the intake air flow-hydraulic servo mechanism 20, the metering plate 21 is rotated against the biasing force of the return spring 225 in accordance with the intake air flow per unit of time. This rotation or the angular displacement of the metering plate 21 is caused by the force of air flow acting on the metering plate 21 and the force of vacuum applied to the diaphragm 33 of the pressure responsive means 30 through the constant differential pressure valve 40.

Meanwhile, the intake air pressures at the upstream and downstream sides of the metering plate 21 are introduced into the pressure chambers 404 and 405 from the ports 222 and 223, respectively. The valve member 408 of the constant differential pressure valve 40 is moved until the pressure differential across the metering plate 21 is balanced with the force of the spring 409. Consequently, an air flow is caused from the atmospheric port 411 into the vacuum passage 410 to adjust the vacuum acting on the upper side of the diaphragm 33 of the pressure responsive means 30 to cause a change of angular position of the metering plate 21 thereby to keep constant the pressure differential across the metering plate 21.

On the other hand, the sectional area of the intake air passage defined between the metering plate 21 and the correcting plate 219 is varied in proportion to the degree of opening $\theta$ of the metering plate 21. It will be seen, therefore, that the opening degree $\theta$ of the metering plate 21 is in proportion to the intake air flow per unit of time because the pressure differential across the metering plate 21 is kept constant and the sectional area of the intake passage is in proportion to the opening degree $\theta$ of the metering plate 21.

Figure 9:
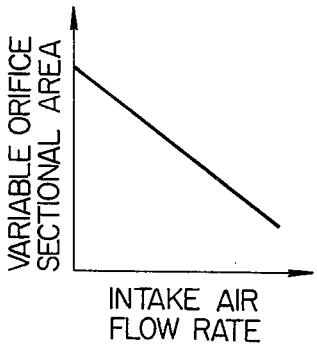
FIG. 9 is a graph for explaining the operation of the system in accordance with the invention.

As a result of rotation of the metering shaft 209 due to the angular movement of the metering plate 21, the sectional area of the variable orifice formed by the notch 208 and the slit 210 is varied in inverse proportion to the intake air flow rate, as shown in FIG. 9. Consequently, the hydraulic servo mechanism 20 acts to allow the fuel to flow back to the fuel tank 60 from a fuel inlet 229 connected to the conduit 69, through a conduit 220, at a rate which is in inverse proportion to the intake air flow rate, so as to change the hydraulic pressure introduced into the working chamber 92 of the fuel controlling mechanism 70 in linear relation to the intake air flow rate. The constant differential pressure valve 214 acts to maintain a constant pressure differential across the variable orifice and to prevent the rate of the fuel flow through the slit 210 from becoming excessively large.

Turning now to the working pressure residing and acting in the working chamber 97 of the fuel controlling mechanism 70, the fuel pumped up by the fuel pump 61 and held at a regulated constant pressure by the regulator 62 is introduced into the working chamber 97 through the fixed restriction 65, conduit 66 and the hydraulic pressure inlet port 98. The fuel introduced into the working chamber 97 then flows through the connection port 100, conduit 99 and the hydraulic pressure inlet port 77 and is introduced into the annular groove 87 in the plunger 81 which is in communication with the slit 79 formed in the plunger-supporting section 71*a* in the axial direction thereof. The fuel is then introduced into the constant differential pressure valve 67 through the fuel return port 80 and the conduit 67*e*. The constant differential pressure valve 67 functions in the same manner as the constant differential pressure valve 214 provided in the intake air flow-hydraulic servo mechanism 20. The fuel flowing out of the constant differential pressure valve 67 is returned to the fuel tank 60 through a conduit.

Figure 5:
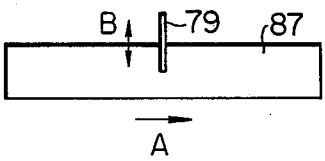

As will be seen from FIG. 5, the area over which the slit 79 in the plunger-supporting section 71*a* and the annular groove 87 in the plunger 81 communicate with each other is varied in accordance with the axial displacement (indicated by an arrow B) of the plunger 81, i.e. the annular groove 87, in inverse proportion to the amount of the displacement. The opening area of the fixed restrictions 65 and 68 are equal to each other and the pressure in the upstream sides of these fixed restrictions are equal to each other. At the same time, the constant differential pressure valves 67 and 214 function equally. Thus, the plunger 81 is axially moved until the hydraulic pressure in the working chamber 92 at the right-hand end of the plunger 81 is balanced with the hydraulic pressure in the working chamber 97 acting on the left-hand end of the plunger 81, thereby to adjust the area over which the slit 79 and the annular groove 87 communicate each other. Consequently, the plunger 81 is moved to a position where the area over which the notch 208 and the slit 210 of the intake air flow-hydraulic servo mechanism 20 communicate with each other is equal to the area over which the slit 79 and the groove 87 of the fuel controlling mechanism communicate with each other. Since the area over which the slit 210 and the notch 208 communicate with each other is in linear relation to the intake air flow rate, the axial displacement of the plunger 81 is also in linear relation to the intake air flow rate.

Turning now to the fuel injection into the engine, the fuel pumped up by the fuel pump 61 and held at a regulated constant pressure by the regulator 62 is introduced into the fuel inlet port 72 of the fuel controlling mechanism 70, via the conduit 63, and flows into the fuel passage 82 through the annular groove in the plunger 81 and the fuel introducing ports 83. As the orifice 85 in the plunger is moved by the rotation of the plunger into overlapping and communicating relationship with successive slits 76*a*–76*d* which are in communication with the fuel outlet ports 74*a*–74*d*, respectively, the fuel is distributed from the fuel passage 82 through the orifice 85 to respective fuel outlet ports and thus to respective fuel injectors.

Since the plunger 81 makes one rotation while the crank shaft of the engine 10 makes two revolutions, each of the fuel outlet ports 74*a*–74*d* receives the fuel in every two revolutions of the crank shaft of the engine 10. Since the illustrated engine 10 is a 4-stroke engine which performs one cycle of operation in two revolutions of the crank shaft, it is possible to supply all cylinders of the engine 10 with the fuel at adequate timing in their strokes. Thus, the fuel injection is made for each cylinder intermittently.

It will be seen that the rate of fuel distribution to each cylinder is adequately controlled in response to variation in the intake air flow rate, since the plunger 81 is axially moved (as indicated by an arrow B in FIG. 4) hydraulically with respect to the housing 71 in response to the change of the intake air flow rate, and since the area and angular extent over which the orifice 85 in the plunger 81 overlaps each of the slits 76*a*–76*d* are changed by the axial displacement of the plunger 81.

As has been described, according to the invention, a plunger for distributing and metering the fuel is adapted to be axially displaced by the hydraulic pressures in two working chambers disposed at respective axial ends of the plunger. The pressure in one of the working chambers is changed in response to the change of the intake air flow rate, while the pressure in the other working chamber is changed in response to the axial displacement of the plunger. Consequently, the part of the fuel injection system constituting the air flow metering sensor is mechanically separated from the part of the injection system constituting the fuel controlling device. Thus, no mechanical linkage between these parts is required and these parts may be connected only hydraulically through conduit means whereby easy mounting of the fuel injection system in a limited space of the engine room is assured. In addition, since the mechanical linkage which inevitably involves mechanical plays is eliminated, an improved precision of the fuel control in response to the varying intake air flow rate is ensured. According to the present invention, moreover, the hydraulic pressure acting on one end of the plunger is varied in accordance with the variation in the intake air flow rate, while the hydraulic pressure acting on the other end of the plunger is varied in accordance with the axial position of the plunger by means of a variable orifice defined by a slit and a groove in the housing and plunger, respectively. Thus, the plunger can be hydraulically driven such that the axial position of the plunger is determined on the basis of the intake air flow rate. The use of hydraulic pressures to axially move the plunger to a position where the pressures are balanced, and more particularly, the use of the hydraulic pressure in place of a compression spring heretofore used to provide a return force to the plunger, eliminates the prior art problem that the equilibrium position of the plunger is varied in use of the system for a prolonged period of time because of the deterioration of the mechanical property of the return spring.

What is claimed is:

1. A fuel metering and distributing device for use in a fuel injection system for an internal combustion engine, comprising a housing having a fuel inlet port and fuel outlet ports formed therein; a plunger mounted in said housing rotatably and axially movably to meter the fuel from said fuel inlet port and distribute the metered fuel to said fuel outlet ports, two hydraulic pressure chambers disposed at respective axial ends of said plunger, the hydraulic pressures in said hydraulic pressure chambers determining the axial displacement of said plunger, an intake air flow-hydraulic servo mechanism having a first variable orifice operative in response to a change of the intake air flow rate to vary the hydraulic pressure in one of said pressure chambers, and a second variable orifice for controlling the hydraulic pressure in the other pressure chamber in accordance with the axial displacement of said plunger, whereby said plunger is axially moved to a position where the hydraulic pressures in said pressure chambers are balanced.

2. A fuel metering and distributing device for use in a fuel injection for an internal combustion engine, comprising:

fuel injectors adapted to be mounted on the engine;

a fuel source operative to supply a fuel under a predetermined pressure to said fuel injectors;

means for metering the fuel from said fuel source and distributing the metered fuel to said fuel injectors;

said fuel metering and distributing means including a housing defining therein a fuel inlet port connected to said fuel source and fuel outlet ports each connected to one of said fuel injectors;

said fuel metering and distributing means further including a plunger and means defining a plurality of apertures;

said plunger being mounted in said housing for rotation in timed relationship to the engine operation and defining an orifice;

one of said plunger and said aperture defining means being disposed inside the other and defining a fuel passage always in communication with said fuel inlet port in said housing;

each of said apertures being substantially aligned with one of said fuel outlet ports;

the rotation of said plunger moving said orifice into overlapping and communicating relationship with successive apertures to allow the fuel to flow from said fuel passage through the overlapped and communicated orifice and apertures to the associated fuel outlet ports and thus to the associated fuel injectors;

said housing and plunger cooperating to define hydraulic pressure chambers at the opposite ends of said plunger so that the hydraulic pressures in said chambers act on the ends of said plunger, respectively;

said hydraulic pressure chambers being hydraulically connected to said fuel source;

means responsive to variation in the engine intake air flow rate to vary the hydraulic pressure in one of said hydraulic pressure chambers to axially move said plunger so that relative movement between said orifice and said apertures is caused axially of said plunger to vary the rate of fuel flow through said orifice and apertures; and means for controlling the hydraulic pressure in the other hydraulic pressure chamber in accordance with the axial position of said plunger relative to said aperture defining means, comprising a second variable orifice disposed between said other hydraulic pressure chamber and said low pressure fuel source, said second variable orifice being defined by the cooperation of said plunger and housing.

3. A fuel metering and distributing device for use in a fuel injection system as defined in claim 2, wherein said apertures are formed in said housing and communicated with said fuel outlet ports, respectively.

4. A fuel metering and distributing device for use in a fuel injection system as defined in claim 2 or 3, wherein said engine includes an air intake duct, and said fuel source includes high and low pressure fuel sources, said fuel inlet port being connected to said high pressure fuel source, said one hydraulic pressure chamber being connected to both of said high and low pressure fuel sources, and wherein said intake air flow rate responsive means includes:

a plate member disposed in said air intake duct and movable in response to variation in the rate of air flow through said duct to vary the air-flow sectional area defined between said duct and said plate member;

means for controlling the plate member so that a substantially constant difference is maintained between the air pressures upstream and downstream of said plate member; and means defining a first variable orifice disposed between said one hydraulic pressure chamber and said low pressure fuel source;

said variable orifice defining means being operatively associated with said plate member so that the area of opening of said first variable orifice is varied by the movement of said plate member to vary the hydraulic pressure in said one hydraulic pressure chamber.

* * * * *